US009283420B2

(12) United States Patent
Seaton et al.

(10) Patent No.: US 9,283,420 B2
(45) Date of Patent: Mar. 15, 2016

(54) VIBRATION APPARATUS

(75) Inventors: Murray Seaton, Noosaville (AU); Lee Blattmann, Balmain (AU)

(73) Assignee: HYPERVIBE PTY LTD, Noosaville (AU)

( * ) Notice: Subject to any disclaimer, the term of this patent is extended or adjusted under 35 U.S.C. 154(b) by 821 days.

(21) Appl. No.: 13/635,366

(22) PCT Filed: Mar. 15, 2011

(86) PCT No.: PCT/AU2011/000288

§ 371 (c)(1), (2), (4) Date: Sep. 14, 2012

(87) PCT Pub. No.: WO2011/113092

PCT Pub. Date: Sep. 22, 2011

(65) Prior Publication Data

US 2013/0012849 A1 Jan. 10, 2013

(30) Foreign Application Priority Data

Mar. 15, 2010 (AU) ..... 2010901091
Apr. 29, 2010 (AU) ..... 2010901807

(51) Int. Cl.

| | |
|---|---|
| ***A61H 1/00*** | (2006.01) |
| ***A61H 1/02*** | (2006.01) |
| ***A63B 21/00*** | (2006.01) |
| ***A61H 23/02*** | (2006.01) |
| ***A63B 21/005*** | (2006.01) |

(52) U.S. Cl.

CPC ..... *A63B 21/00196* (2013.01); *A61H 1/005* (2013.01); *A61H 23/0254* (2013.01); *A63B 21/0058* (2013.01); *A63B 21/00072* (2013.01); *A61H 2201/1481* (2013.01); *A61H 2201/164* (2013.01); *A61H 2201/1678* (2013.01)

(58) Field of Classification Search

CPC ..... A61H 1/005; A61H 23/0254; A61H 2201/1481; A61H 2201/149; A63B 21/00196; F16H 25/12; F16H 25/122

See application file for complete search history.

(56) References Cited

U.S. PATENT DOCUMENTS

| | | | | |
|---|---|---|---|---|
| 2005/0033203 | A1 | 2/2005 | Son et al. | |
| 2007/0225622 | A1 * | 9/2007 | Huang | A61H 1/005 601/30 |
| 2010/0038983 | A1 * | 2/2010 | Bhugra | A61F 2/68 310/83 |
| 2010/0234187 | A1 | 9/2010 | Lanny | |

FOREIGN PATENT DOCUMENTS

| | | | |
|---|---|---|---|
| DE | 102 28 944 | A1 | 1/2003 |
| EP | 1 683 505 | A1 | 7/2006 |
| JP | 2006289051 | A | 10/2006 |
| JP | 2008200433 | A | 9/2008 |
| WO | WO 2009/062700 | A1 | 5/2009 |

* cited by examiner

*Primary Examiner* — Justine Yu
*Assistant Examiner* — Kathrynn Lyddane
(74) *Attorney, Agent, or Firm* — Birch, Stewart, Kolasch & Birch, LLP

(57) ABSTRACT

A pivotal vibration apparatus comprising a vibration platform, a displacement assembly having an eccentric shaft rotatable to provide a displacement force, a link connecting the displacement assembly to the vibration platform to transfer the displacement thereto and an adjustment mechanism to adjust the amplitude of the displacement force transmitted to the vibration platform in a continuous fashion.

15 Claims, 13 Drawing Sheets

VIBRATION APPARATUS

This application is the National Stage under 35 USC §371 of International Application PCT/AU2011/000288 filed Mar. 15, 2011, which claims priority under 35 USC §119(a)-(d) of Application No. 2010901091 filed in Australia on Mar. 15, 2010 and Application No. 2010901807 filed in Australia on Apr. 29, 2010.

FIELD OF THE INVENTION

The present invention relates to the field of training and physical therapy apparatus. More particularly, this invention relates to an improved vibrational training apparatus.

BACKGROUND OF THE INVENTION

Whole body vibration, as the name suggests, refers to mechanical oscillations which are applied to the entire body as opposed to a localised application. Recently this principle has been used in the fitness and physical therapy fields in the form of vibration training.

In vibration training the user may stand or otherwise make contact with a vibrating platform and their musculo-skeletal system is exposed to high speed oscillations causing a range of muscles to contract and relax on a continuous basis thereby building and strengthening muscle. Vibration training also provides substantial therapeutic benefits in terms of increasing bone density, aiding mobility and improving tissue perfusion, to name but a few.

There are three factors to be considered in designing vibration training machines and these are the amplitude of the displacement of the platform, being the distance travelled between two points, the frequency of the oscillations, being the number of oscillations per second, and the G force, being the acceleration of the displacement felt by the user which ultimately determines the magnitude of the load applied to the muscles. These factors are inextricably linked and so, for example, if a vibration machine has a small amplitude of displacement of its vibration platform then a higher frequency of vibrations will be required to provide the same G force as is achieved by a machine with a platform having a greater amplitude of vibration.

There are currently two different types of vibration training machines, the lineal and pivotal forms. Lineal vibration machines have a vibration platform which simply moves vertically up and down between two points, much in the manner of an elevator. Some lineal machines allow displacement modulation whereby the user may have a choice of, typically, two settings. This may allow for a 'low' setting whereby the amplitude of displacement of the platform is, typically, 2 mm and a 'high' setting with a vibration amplitude of, typically, 4 mm.

Lineal vibration, because of its relatively small amplitude of vibration, typically operates at relatively high frequencies (25-50 Hz) to achieve a useful working G force. However, for use by elderly people the displacement can be kept low to produce a low G force thereby making the machine safer for this group. Lineal machines thus provide some advantages in terms of control over G force applied to the user. The main drawback associated with lineal machines is that the nature of the movement they produce means that the transmission of vibrational mechanical energy to the head is quite keenly felt by the user. This results in many users finding lineal machines too uncomfortable to use for extended periods of time, due to the onset of headaches, neck pain etc, and raises concerns about their safety.

The second type of vibration training machine is a pivotal machine in which a pivotal vibration platform oscillates around a central fulcrum, much in the manner of a see saw. Pivotal machines do not provide for displacement modulation per se in the manner of the lineal machine but a user can adjust the amplitude of displacement they are exposed to by moving their stance to be closer to or further away from the fulcrum. This is not entirely satisfactory because when performing certain exercises on the platform the contact points the user makes with the platform need to be a certain distance apart. For example, when performing a push up the user's hands would be roughly shoulder width apart and so placed at opposite ends of the platform and exposed to the maximum displacement amplitude which may be excessive. If a lower displacement amplitude is required the distance between the user's hands, and the exercise position, may need to be altered such that the exercise becomes less effective or even impossible for the user to complete. It is, therefore, more difficult for a user to control the G force they experience during pivotal training.

Since the displacement of a pivotal platform can be up to about 13 mm they tend to operate at lower frequencies than lineal machines to achieve a similar G force output. Further, with a displacement of up to 13 mm, it is difficult to produce an effective low G force pivotal machine for use by the elderly or infirm because of the large amplitude of vibration which cannot be completely offset by a low frequency and still maintain efficacy. Users do report that a pivotal machine has a more comfortable feel in terms of vibration transmission to the head and research has shown that the magnitude of vibration felt in the head region is dramatically lower than for lineal machines.

There is a need for a vibration training machine which can operate over a range of G force output and which avoids at least some of the disadvantages mentioned above.

OBJECT OF THE INVENTION

It is therefore an object of the invention to overcome or alleviate at least one of the aforementioned deficiencies in the prior art or at least provide a useful or commercially attractive alternative.

SUMMARY OF THE INVENTION

In one form the invention resides in a pivotal vibration apparatus comprising:

(a) a vibration platform;

(b) a displacement assembly comprising an eccentric shaft rotatable to provide a displacement amplitude;

(c) a link connecting the displacement assembly to the vibration platform to transfer the displacement thereto; and (d) an adjustment mechanism to adjust the amplitude of the displacement transmitted to the vibration platform.

In one embodiment, the eccentric shaft has an extension shaft extending from at least one end face thereof.

Preferably, the eccentric shaft is at least partially enclosed by and rotatable within a sleeve.

The eccentric shaft is preferably located eccentrically within the sleeve.

The eccentric shaft may be held within bushings which are affixed to the sleeve.

Suitably, the sleeve is provided with a window and at least one spiral groove.

Preferably, the extension shaft extends from an eccentric position on the end face of the eccentric shaft.

The eccentric shaft may be held within a locking mechanism such that rotation of the locking mechanism causes rotation of the eccentric shaft.

Suitably, the locking mechanism has an elongate projection which extends through the window of the sleeve.

Preferably, the adjustment mechanism comprises a shuttle partially enclosing, and adapted to travel along, the sleeve.

Preferably, the shuttle is provided with a slot to accommodate the elongate projection of the locking mechanism.

Suitably, the shuttle is further provided with at least one pin attached to the shuttle and having an end thereof located within the at least one groove of the sleeve.

Preferably, the at least one pin is two pins.

The shuttle may be connected to a yolk adapted to move the shuttle along the sleeve.

Movement of the shuttle causes the pins to travel along the spiral groove to thereby cause the shuttle to rotate relative to the sleeve and the elongate projection to travel along the slot.

Suitably, rotation of the shuttle causes the locking mechanism and attached eccentric shaft to rotate relative to the sleeve to thereby vary the degree of eccentricity between the extension shaft and a centre point of the sleeve.

In a further embodiment, the adjustment mechanism comprises a pivotal arm comprising a pivot point.

Suitably, the eccentric shaft is connected to and causes displacement of the pivotal arm.

Preferably, the link connects the pivotal arm to the vibration platform.

The location of the pivot point is adjustable with respect to the pivotal arm.

It will be appreciated that altering the location of the pivot point on the pivotal arm modulates displacement of the pivotal arm to thereby control the amplitude of vibration of the vibration platform.

Suitably, the eccentric shaft connects with a disc in the pivotal arm such that the centres of the shaft and disc are eccentric.

Preferably, the adjustable pivot point is located within a groove in the pivotal arm.

The adjustable pivot point may be formed by a roller capable of movement along the length of the groove in the pivotal arm.

Suitably, the adjustable pivot point is connected to a carrier located on a spindle and adjustment of the position of the carrier on the spindle results in the adjustable pivot point moving along the groove in the pivotal arm.

In one general embodiment, the invention resides in a pivotal vibration apparatus comprising:

(a) a vibration platform;

(b) a displacement assembly comprising an eccentric shaft having an extension shaft extending from at least one end face thereof, the eccentric shaft at least partially enclosed by and rotatable within a sleeve;

(c) a link connecting the vibration platform to the extension shaft; and wherein, the eccentric shaft is located eccentrically within the sleeve and the extension shaft extends from an eccentric position on the end face of the eccentric shaft.

Suitably, the eccentric shaft is held within bushings affixed to the sleeve.

Preferably, the sleeve is provided with a window and at least one spiral groove.

The eccentric shaft is held within a locking mechanism such that rotation of the locking mechanism causes rotation of the eccentric shaft.

It is preferred that the locking mechanism has an elongate projection which extends through the window of the sleeve.

Suitably, the sleeve has a shuttle partially enclosing a portion thereof.

Preferably, the shuttle is adapted to travel along an outer surface of the sleeve.

The shuttle may be provided with a slot to accommodate the elongate projection of the locking mechanism.

Preferably, the shuttle is further provided with at least one pin, preferably two pins, attached to the shuttle and having an end thereof located within the at least one groove of the sleeve.

The shuttle may be connected to a yolk adapted to move the shuttle along the sleeve.

The yolk may be drawn along a spindle by a position sensitive motor.

It should be understood that movement of the shuttle causes the pin to travel along the spiral groove to thereby cause the shuttle to rotate relative to the sleeve and the elongate projection to travel along the slot. Rotation of the shuttle causes the locking mechanism and attached shaft to rotate relative to the sleeve to thereby vary the degree of eccentricity between the extension shaft and a centre point of the sleeve.

In a second embodiment, the invention resides in a vibration apparatus comprising a vibration platform, a pivotal arm and a link operatively connecting the vibration platform and pivotal arm, wherein the pivotal arm has an adjustable pivot point to provide amplitude control of the vibration platform.

In one form of the second embodiment, the invention resides in a vibration apparatus comprising:

(a) a vibration platform;

(b) a pivotal arm comprising a pivot point;

(c) a displacement member connected to and causing displacement of the pivotal arm; and (d) a link connecting the vibration platform to the pivotal arm;

wherein, the location of the pivot point is adjustable with respect to the pivotal arm.

It will be appreciated that altering the location of the pivot point on the pivotal arm modulates displacement of the pivotal arm to thereby control the amplitude of vibration of the vibration platform.

Preferably, the link is pivotally connected to both the vibration platform and the pivotal arm.

Suitably, the displacement member is an eccentric mechanism.

The eccentric mechanism may comprise a shaft driven by a belt connected to a motor.

Suitably, the shaft connects with a disc such that the centres of the shaft and disc are eccentric.

The adjustable pivot point may be located within a groove in the pivot arm.

In one embodiment, the adjustable pivot point is formed by a roller capable of movement along the length of the groove in the pivot arm.

Preferably, the adjustable pivot point is mechanically varied.

The adjustable pivot point may be mechanically varied by means of a motorised system, a hydraulic system or the like.

Preferably, the adjustable pivot point is connected to a carrier located on a spindle and adjustment of the position of the carrier on the spindle results in the adjustable pivot point moving along the groove in the pivot arm.

A stepper motor may be used to control the position of the carrier on the spindle.

The vibration platform will vibrate around a central fulcrum.

Suitably, the vibration apparatus is a pivotal vibration training apparatus.

The link may be connected to a lateral region of the vibration platform to raise and lower that region about the fulcrum to thereby impart vibratory motion to the vibration platform.

Therefore, in a particularly preferred form of the second embodiment the invention resides in a pivotal vibration apparatus comprising:

(a) a vibration platform adapted to vibrate about a centrally located fulcrum;

(b) a pivotal arm comprising a groove to retain an adjustable pivot point;

(c) an eccentric displacement member connected to and causing displacement of the pivotal arm;

(d) a link connecting a lateral region of the vibration platform to the pivotal arm; and wherein, moving the adjustable pivot point relative to the eccentric displacement member modulates the amplitude of the vibrations of the lateral region of the vibration platform.

Further features of the present invention will become apparent from the following detailed description.

Throughout this specification, unless the context requires otherwise, the words "comprise", "comprises" and "comprising" will be understood to imply the inclusion of a stated integer or group of integers but not the exclusion of any other integer or group of integers.

BRIEF DESCRIPTION OF THE FIGURES

In order that the invention may be readily understood and put into practical effect, preferred embodiments will now be described by way of example with reference to the accompanying figures wherein like reference numerals refer to like parts and wherein.

DETAILED DESCRIPTION OF THE INVENTION

The present invention provides for amplitude displacement modulation of the vibration platform of a pivotal vibration training apparatus.

Figure 1:
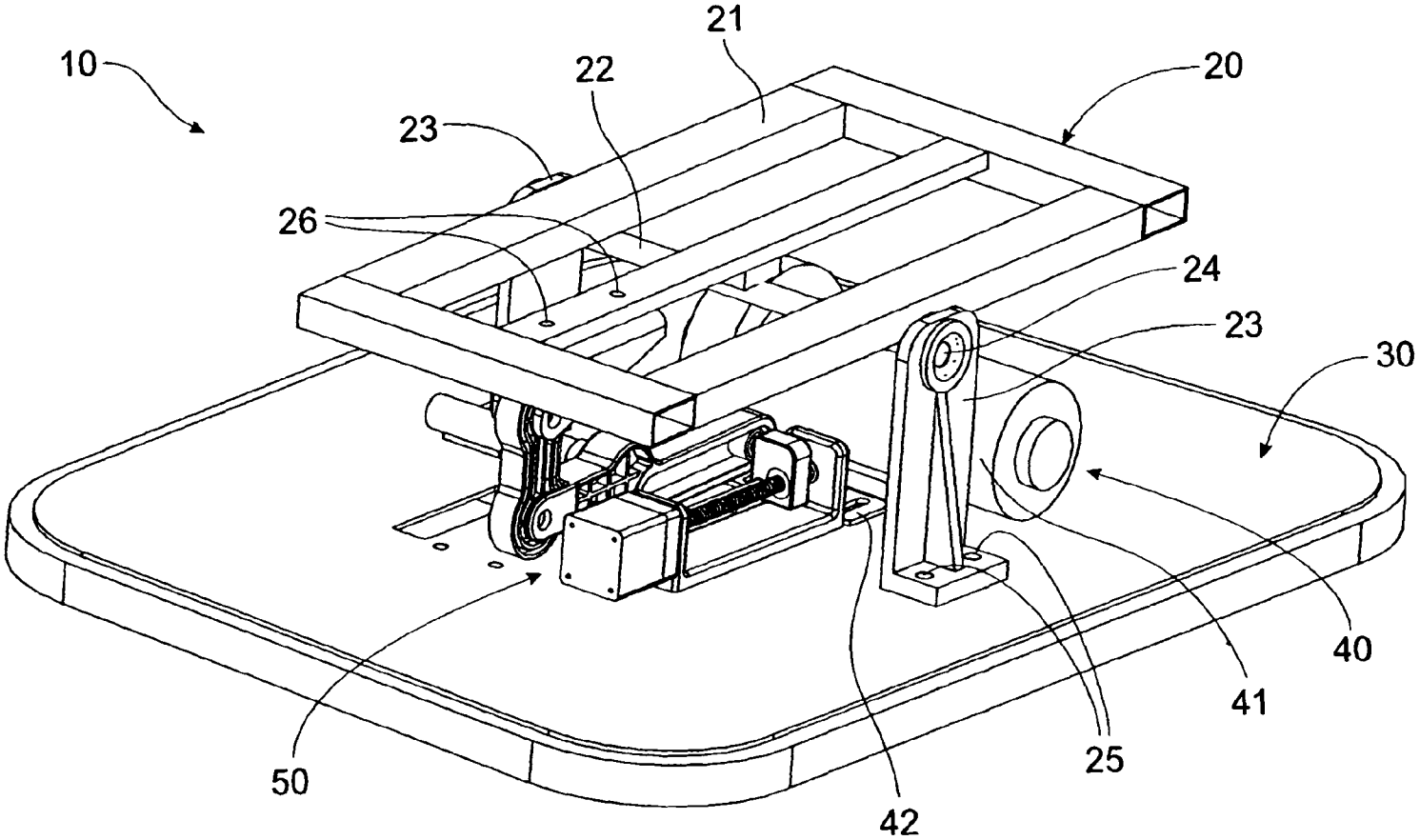
FIG. 1 shows a perspective view of one embodiment of a vibration apparatus.

FIG. 1 shows a perspective view of one embodiment of a vibration apparatus 10. Vibration apparatus 10 comprises a platform assembly 20, base 30, motor assembly 40 and displacement assembly 50.

Platform assembly 20 comprises a vibration platform in the form of a frame 21 which, on its underside, is in contact with a centrally located cross bar 22 which is supported by two support brackets 23. Support brackets 23 are each provided with an aperture 24 at their upper extent which receives an end of cross bar 22 and maintains it in position. Support brackets 23 are provided with fasteners 25 at their lower extent to attach them to base 30 while one lateral end of frame 21 can be seen to have receiving apertures 26 passing therethough.

Frame 21 provides a framework for attachment of a user platform (not shown in the FIGs) upon which a user can stand or otherwise make contact with to attain the benefits of the vibration apparatus 10. Cross bar 22 passes along a central plane of frame 21 and is free to rotate within apertures 24 of support brackets 23 and thus acts as a fulcrum about which frame 21 (and attached user platform) can oscillate or vibrate, much in the manner of a see saw.

Frame 21, cross bar 22 and support brackets 23 may all be made from a range of materials which provided suitable strength and resistance deformation including a range of metals and metal alloys as well as certain plastics and other polymers. Particularly preferred materials for the manufacture of these components are iron and iron alloys.

Motor assembly 40 comprises motor 41 which is held in place by a motor mount 42 fastened to base 30. Motor 41 may be any sort of motor suitable for the purpose of driving the displacement mechanisms described herein. DC motors are preferred due to their greater longevity and ease of control.

Displacement assembly 50, driven by motor 41, causes and controls the vibratory movement of frame 21 and will be described in more detail in relation to FIGS. 2 and 3.

Figure 2:
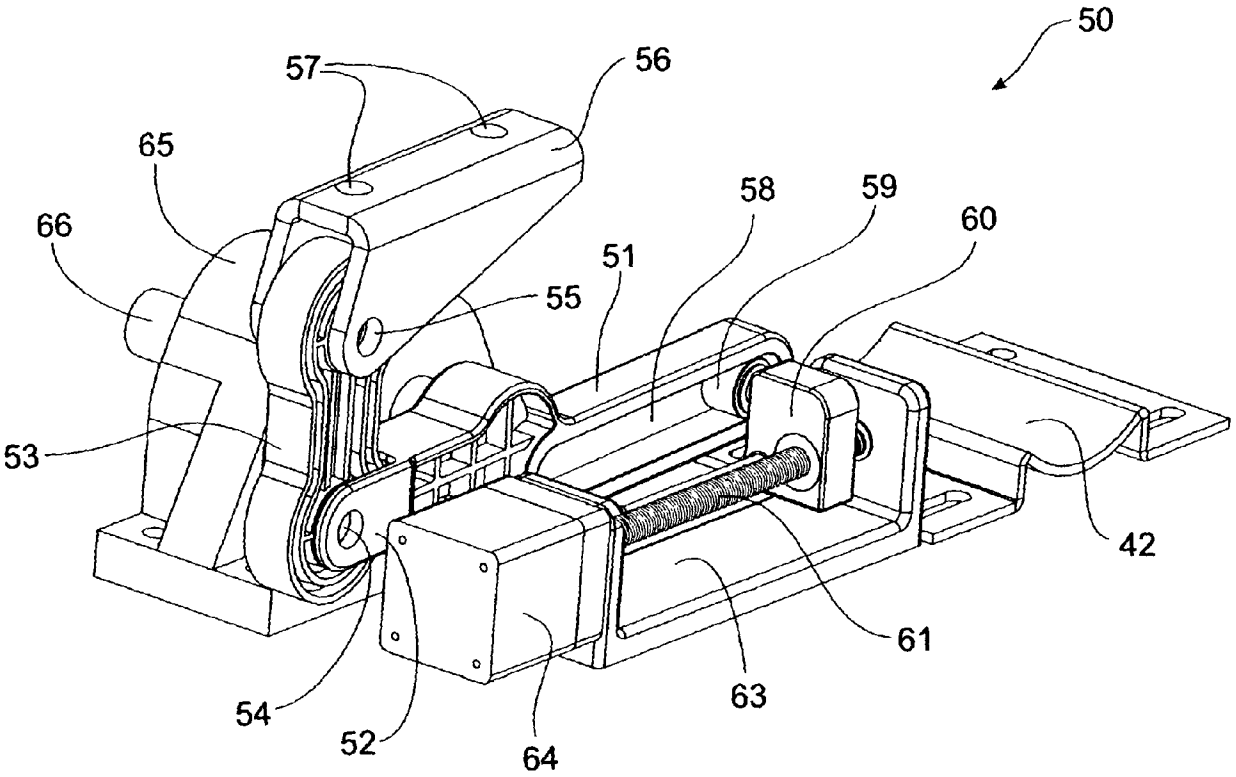
FIG. 2 shows a perspective view of a displacement assembly being a part of the vibration apparatus shown in FIG. 1.
Figure 3:
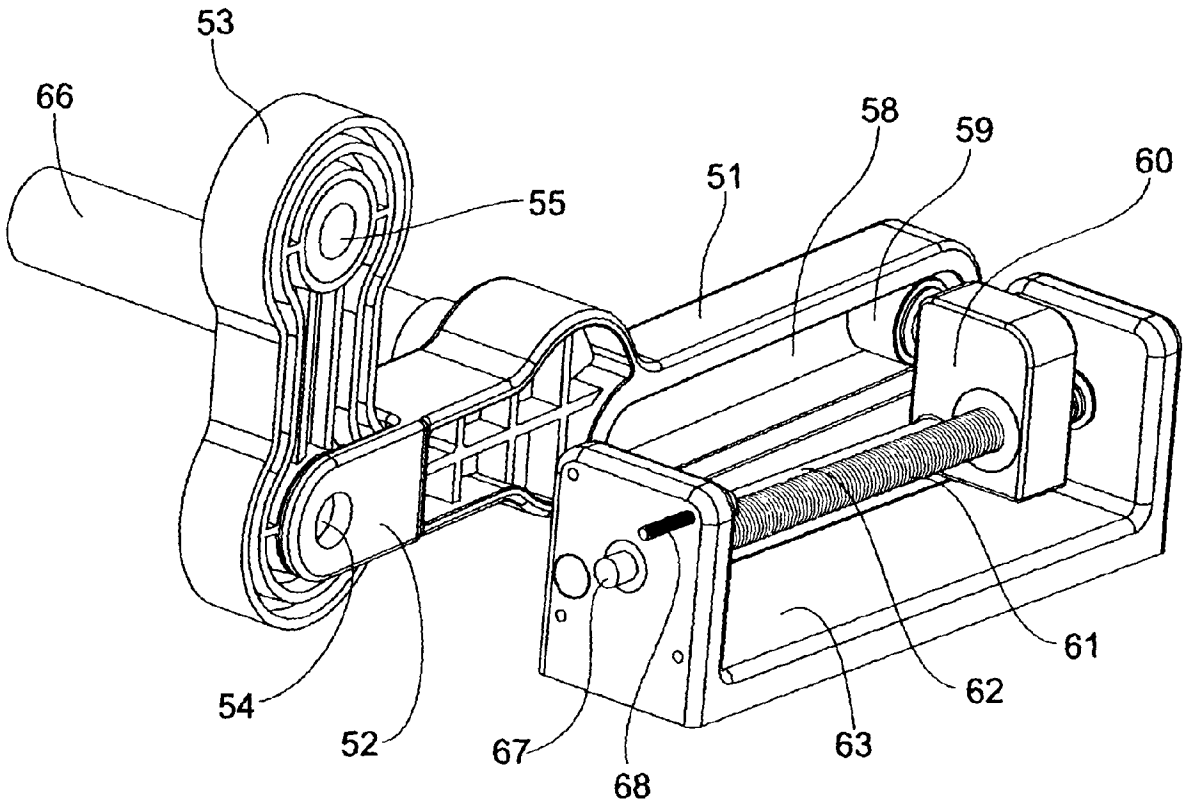
FIG. 3 shows a perspective view of certain components of the displacement assembly shown in FIG. 2.

FIG. 2 shows a perspective view of displacement assembly 50 being a part of vibration apparatus 10 shown in FIG. 1 while FIG. 3 shows a perspective view of certain components of displacement assembly 50 shown in FIG. 2.

At the core of displacement assembly 50 is a pivotal arm which, in the embodiment shown in the FIGs, takes the form of a rocker arm 51. One end of rocker arm 51 forms a clevis 52 which receives a link which, in the embodiment shown, takes the form of a yoke 53. Yoke 53 is attached, at its lower extent, by a first pivotal connection 54 to clevis 52 of rocker arm 51 and, at its upper extent, by a second pivotal connection 55 to a yoke hanger bracket 56. Yoke hanger bracket 56 is provided with two yoke bracket apertures 57 which, in use, are in alignment with receiving apertures 26 of frame 21 to receive fasteners therein and affix yoke hanger bracket 56 to the underside of a lateral region of frame 21.

It can thus be seen that yoke 53 forms a link between rocker arm 51 and platform assembly 20 to transfer any displacement of rocker arm 51 into vibration/oscillation of frame 21 around its fulcrum i.e. cross bar 22.

At the opposite lateral end of rocker arm 51 to clevis 52, rocker arm 51 is provided with a track or groove 58 which receives an adjustable pivot point which, in the embodiment shown in the FIGs, is a pivot roller 59 which is connected to a roller carrier 60 disposed on and threadedly associated with a spindle 61 as well as cradle rod 62 which both sit adjacent to and substantially parallel with groove 58. Spindle 61 and cradle member 62 sit within a roller cradle 63 to hold them in place and provide sufficient space for roller carrier 60 to track along the length of spindle 61. Cradle rod 62 prevents the rotation of roller carrier 60 and ensures its movement along spindle 61. At one end of roller cradle 63, as shown in FIG. 2, is a spindle driver which, in the embodiment shown, takes the form of a stepper motor 64 to allow continuous adjustment of the position roller carrier 60 takes along spindle 61.

It should be clear that pivot roller 59 acts as a pivot point for rocker arm 51 and so the particular position pivot roller 59 takes within groove 58 will determine the amplitude of the displacement which clevis 52 and, hence, yoke 53 undergo. This movement will then be transmitted through yoke hanger bracket 56 to frame 21 resulting in movement about its fulcrum and hence a displacement from the horizontal will be passed on to the platform upon which the user is making contact.

Rocker arm 51 is interposed between roller cradle 63 and a bearing housing 65 through which at least part of a displacement member passes which, in the embodiment shown, takes the form of a shaft 66. Shaft 66 connects with an approximately central region of rocker arm 51 as will be discussed in more detail in relation to FIG. 5. Bearing housing 65 may provide a journal bearing, otherwise known as a radial or rotary bearing, for shaft 66 which will therefore rotate within bearing housing 65. Shaft 66 can be seen to extend out of both flat faces of bearing housing 65.

FIG. 3 shows essentially the same view as FIG. 2 but with certain components of displacement assembly 50 not shown to clarify the interplay of those remaining components. Specifically, yoke hanger bracket 56, bearing housing 65, stepper motor 64 and motor mount 42 are not shown.

A spindle projection 67 passes through one side wall of roller cradle 63 to connect with stepper motor 64 which acts on spindle projection 67 to effect rotation of spindle 61. Stepper motor fastener 68 also projects through the same side wall of roller cradle 63 to fasten stepper motor 68 in place.

Figure 4:
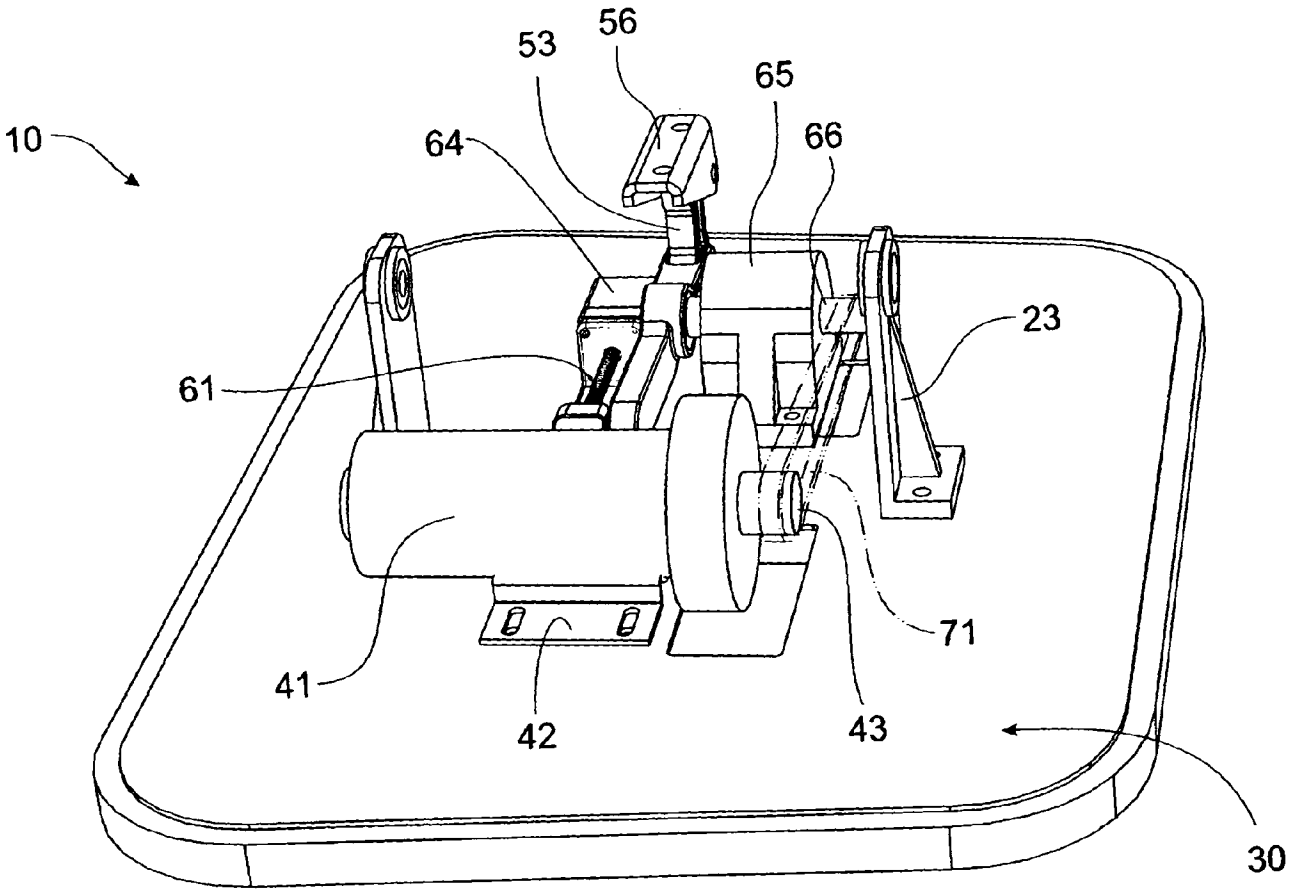
FIG. 4 shows a perspective view of certain components of the vibration apparatus shown in FIG. 1.

FIG. 4 shows a perspective view of certain components of the vibration apparatus shown in FIG. 1. Frame 21 is not shown in FIG. 1 in order to better view certain of the other components. For example, cradle rod 62 and its position relative to spindle 61 is more clearly visible.

The view shown in FIG. 4 enables motor drive shaft 43 to be seen projecting out from one end of motor 41. Motor drive shaft 43 is in rough alignment with a portion of shaft 66 and, in use, a belt drive mechanism 71 may extend between these two components and may incorporate other elements such as, for example, a drive sprocket, as may be necessary. The belt drive 71 will transfer the motion generated by motor 41 to shaft 66.

Figure 5:
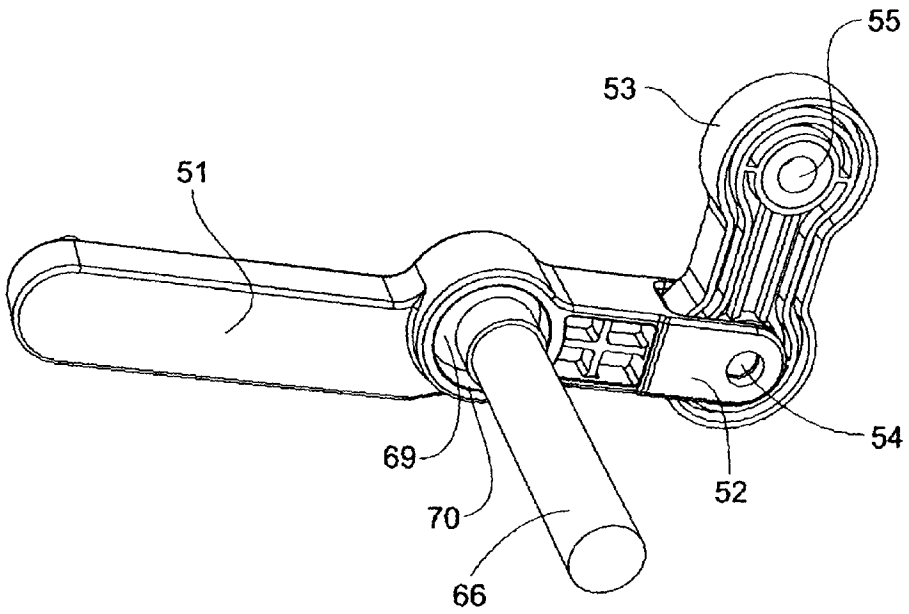
FIG. 5 shows a perspective view of rocker arm, shaft and yoke components of the displacement assembly shown in FIG. 2.

FIG. 5 shows a perspective view of rocker arm 51, shaft 66 and yoke 53 components of displacement assembly 50 shown in FIG. 2. The view shown in FIG. 5 is of the other side of rocker arm 51 to that shown in FIGS. 1 to 3. The displacement member is seen to take the form of shaft 66 and an attached disc 69 which together form an eccentric mechanism due to the fact that shaft 66 and disc 69 do not share the same centre. Disc 69 is seen to connect with rocker arm 51 within rocker aperture 70. The placement of yoke 53 within the two arms of clevis 52 end of rocker arm 51 can also be seen.

The eccentric relationship of shaft 66 and disc 69 means that when shaft 66 is caused to rotate about its central axis then attached disc 69 will be caused to rotate within rocker aperture 70 to translate the rotational motion of shaft 66 into reciprocating motion of rocker arm 51.

The operation of vibration apparatus 10 shall now be described in detail with reference to the figures. Activation of motor 41 will cause rotation of motor drive shaft 43 which, via a belt drive 71 or other like mechanism which would be well known to the skilled addressee, results in rotation of shaft 66. The eccentricity between the centre of shaft 66 and the centre of disc 69 results in the cyclical displacement of rocker arm 51.

Rocker arm 51 will be displaced around the pivot point created by the placement of pivot roller 59 within groove 58 of rocker arm 51. The exact placement of pivot roller 59 will determine the amplitude of motion which clevis 52 of rocker arm 51 undergoes. For example, in FIGS. 2 and 3 pivot roller 59 is located in a portion of groove 58 furthest away from clevis 52 end of rocker arm 51 and this will result in a smaller amplitude of displacement of clevis 52 than if pivot roller 59 were located in a portion of groove 58 nearest clevis 52 end of rocker arm 51. The amplitude of displacement will be modulated in a continuous manner between these two extremes by the controlled movement of pivot roller 59.

Activation of stepper motor 64 will initiate rotation of spindle projection 67 and hence spindle 61. Depending on whether the rotation is clockwise or anticlockwise this will cause roller carrier 60 to move along spindle 61 to be closer to or further away from the stepper motor 64 end of roller cradle 63. Roller carrier 60, when it moves along spindle 61, carries with it pivot roller 59 which is adapted to track or roll along groove 58 of rocker arm 51 thus modulating the displacement of rocker arm 51, as just described.

Any modulation of the displacement of the clevis 52 end of rocker arm 51 is immediately translated into the amplitude of motion undergone by yoke 53 which, via its connection through yoke hanger bracket 56 to a lateral region of frame 21, causes frame 21 to undergo a see saw like movement of like amplitude around its fulcrum point, as provided by cross bar 22. This results in a like movement of the platform on which the user can stand which will be located directly over frame 21.

Figure 6:
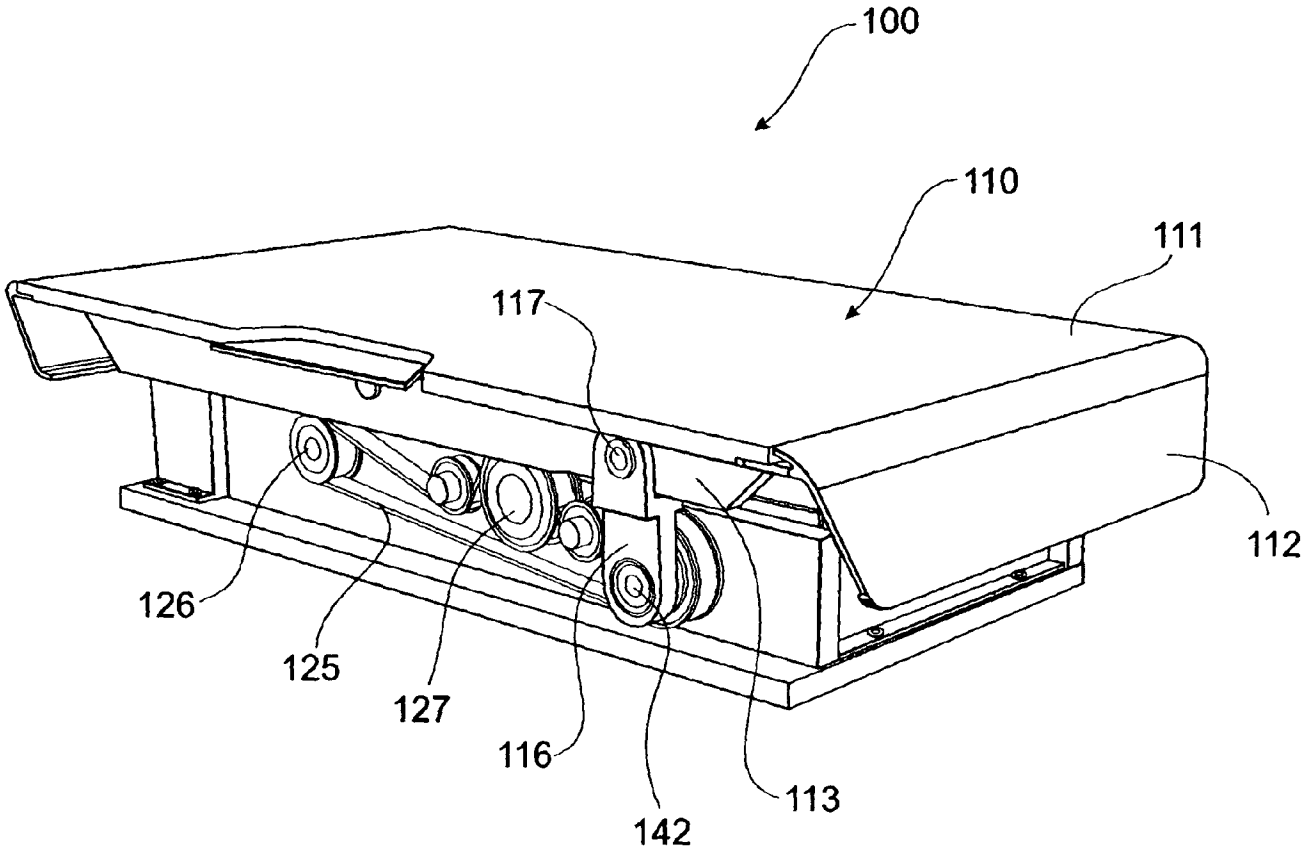
FIG. 6 shows a perspective view of a further embodiment of a vibration apparatus.
Figure 7:
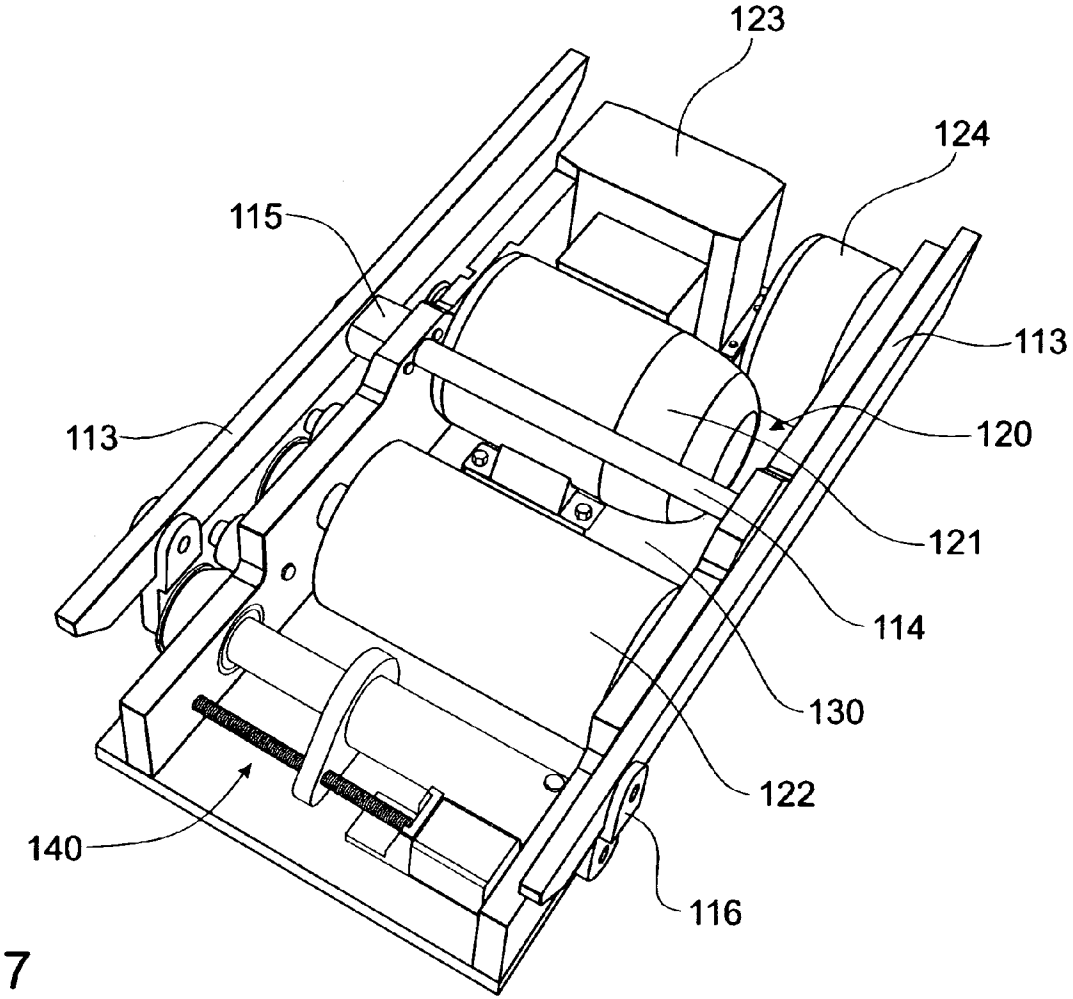
FIG. 7 shows a perspective view of the inner components of the vibration apparatus of FIG. 6.

FIG. 6 shows a perspective view of a preferred embodiment of a vibration apparatus 100 according to the present invention and FIG. 7 shows a perspective view of the inner components of vibration apparatus 100. Platform assembly 110 comprises a planar vibration platform 111 on which a user can stand. Wings 112 are provided on opposing ends of vibration platform 110.

Side panels 113 run along each elongate edge of vibration apparatus 100 between wings 112 and are attached to an underside of vibration platform 111. Vibration platform 111 has been removed from the view in FIG. 7 to enable the inner components to be more easily viewed and so centrally located cross bar 114 is visible. Cross bar 114 acts as a fulcrum about which vibration platform 111 can oscillate in a see saw like motion. Cross bar 114 is attached to the body of vibration apparatus 100 by brackets 115.

A link in the form of a connecting rod 116 attaches to each side panel 113 via a fastener 117 at its upper extent and, at its lower extent, to an extension shaft 142 which will be described in greater depth in relation to FIG. 8A. Connecting rod 116 acts to transfer the amplitude of displacement of each extension shaft 142 into oscillating or vibratory motion of vibration platform 111.

A drive assembly 120 is provided which comprises a motor 121 which may be of a design as described for vibration apparatus 10. A fly wheel 122 is provided to smooth out highs and lows in the motion of an associated belt. Standard electrical components 123 and 124 are provided to accompany motor 121 and provide the necessary power adjustments etc. For example, they may be a toroidal transformer 124 and power unit 123. Motor 121 drives a drive belt 125 which contacts motor 121 at shaft 126. Belt 125, as seen in FIG. 6, has a serpentine path allowing it to contact and transfer motion to a number of components which will be described hereinafter.

Motor 121, fly wheel 122 and other components seen in FIG. 7 are fastened to a base 130 of vibration apparatus 100. Adjacent fly wheel 122 is displacement assembly 140 which enables amplitude modulation of the oscillation of vibration platform 111. The remaining figures and discussion will address the components and working of displacement assembly 140.

Figure 8A:
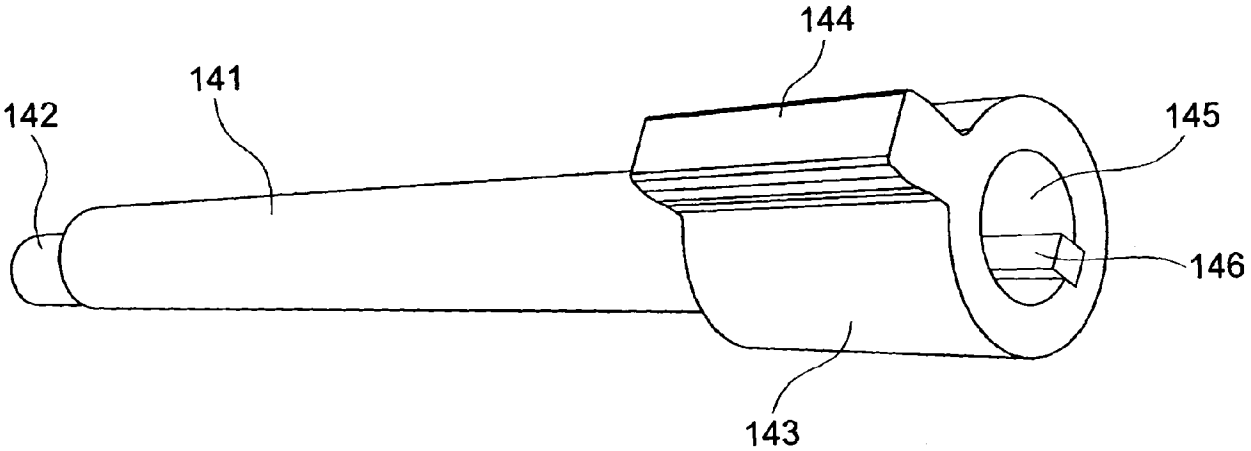
FIG. 8A shows a perspective view of a partial eccentric shaft and locking mechanism as part of the vibration apparatus of FIG. 6.

FIG. 8A shows a perspective view of a partial eccentric shaft and locking mechanism as part of displacement assembly 140. An eccentric shaft 141 is provided having extension shaft 142. Eccentric shaft 141 is located within a locking mechanism 143, such as a drive dog, which is itself provided with an elongate projection 144. Locking mechanism 143 has a hollow interior 145 with a lock or key 146 which will fit within a reciprocating space within eccentric shaft 141 (not shown) and hold eccentric shaft 141 in place.

Figure 8B:
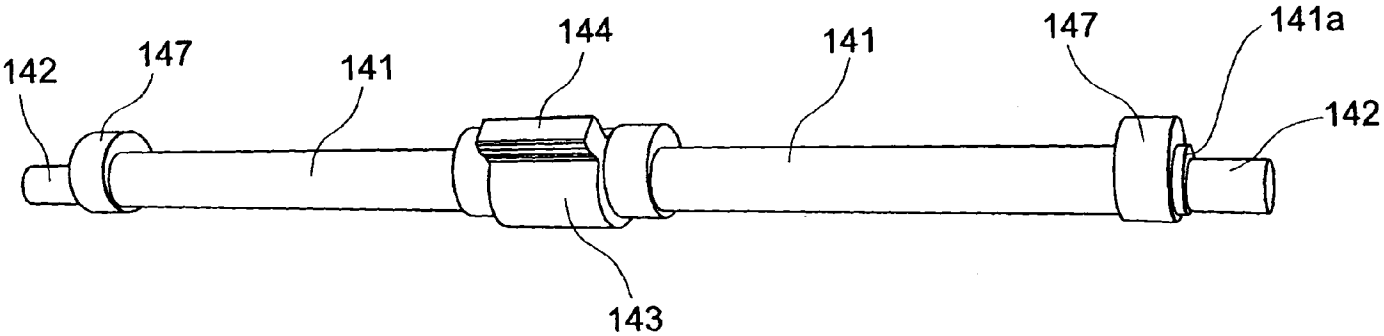
FIG. 8B shows a perspective view of a complete eccentric shaft and locking mechanism as part of the vibration apparatus of FIG. 6.

FIG. 8B essentially shows the same components as FIG. 8A but a further eccentric shaft 141 has been located within locking mechanism 143 which can thus be thought of as accommodating two eccentric half shafts and locking them in place to form one elongate eccentric shaft 141. The end face 141*a* of eccentric shaft 141 can be seen and the eccentric placement of extension shaft 142 within end face 141*a* is indicated. Eccentric shafts 141 and extension shafts 142 are circular in cross section. In FIG. 8B four bushings 147 are seen to extend around eccentric shafts 141, two for each half shaft, and these may be made of brass or similar materials. Eccentric shafts 141 are free to rotate within bushings 147 and, importantly, are located eccentrically within the body of bushings 147.

Thus, looking at the end of FIG. 8B wherein end face 141*a* is visible, it should be understood that the components just described combine to create a first eccentric mechanism (extension shaft 142 located within end face 141*a*) within a second eccentric mechanism (eccentric shaft 141 located within bushings 147). Extension shaft 142 is fixed to or continuous with eccentric shaft 141 and thus rotation of eccentric shaft 141 will create a vertical amplitude of displacement of extension shaft 142.

Figure 9A:
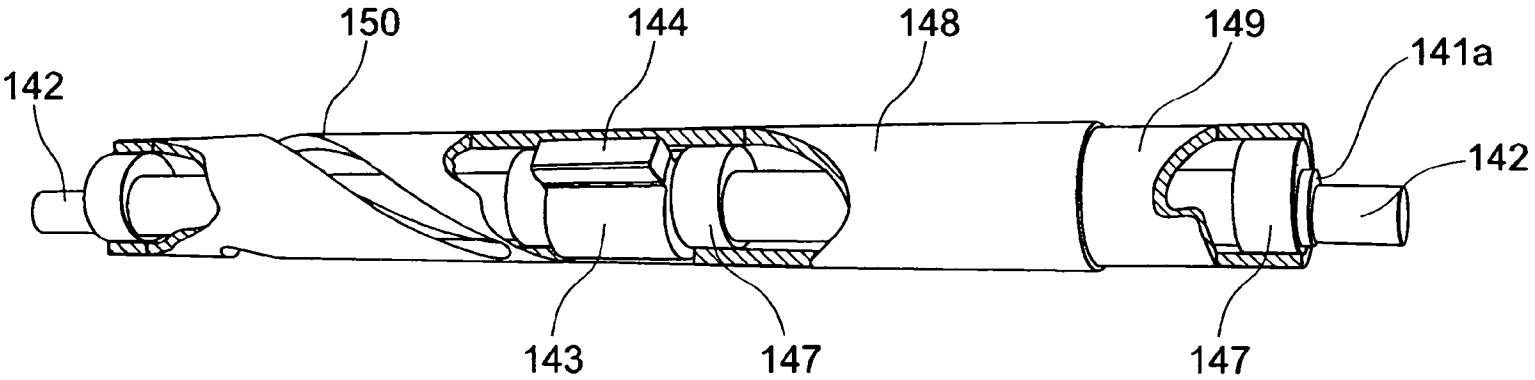
FIG. 9A shows a perspective view of the eccentric shaft and locking mechanism of FIG. 8B enclosed within a sleeve with cut away portions to show the placement of these components.
Figure 9B:
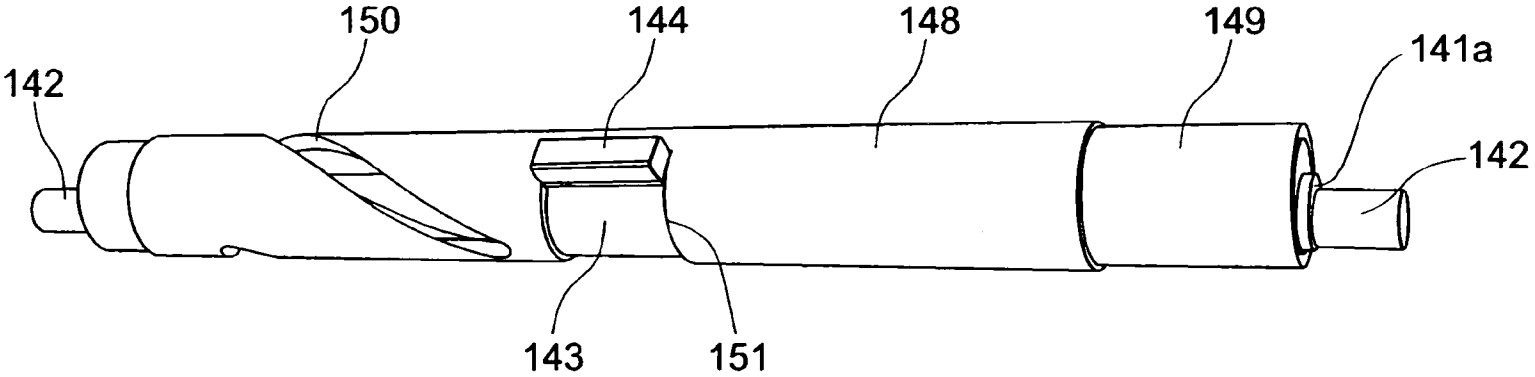
FIG. 9B shows a perspective view of the sleeve shown in FIG. 9A without cut away portions.

FIGS. 9A and 9B show a perspective view of eccentric shaft 141 and locking mechanism of FIG. 8B enclosed within a torque shaft or sleeve 148. Sleeve 148 encloses the majority of the length of eccentric shafts 141 and has a stepped down portion 149 which will receive bearings within which sleeve 148 can rotate. Sleeve 148 is also provided with one or more elongate cut out portions or grooves 150 which extends around a portion of one end of sleeve 148 as well as a further cut away region or window 151 in which locking mechanism 143 is located. The elongate nature of window 151 allows for travel of elongate projection 144 of locking mechanism 143 in an up and down fashion over an angle of approximately 180°.

Bushings 147, as most clearly seen in FIG. 9A, are an interference fit within the hollow interior of sleeve 148 and are held in place by spring pins or like fastening means. This arrangement means that sleeve 148 and bushings 147 will turn together when vibration apparatus 100 is activated while eccentric shafts 141 are free to rotate within them.

Figure 10:
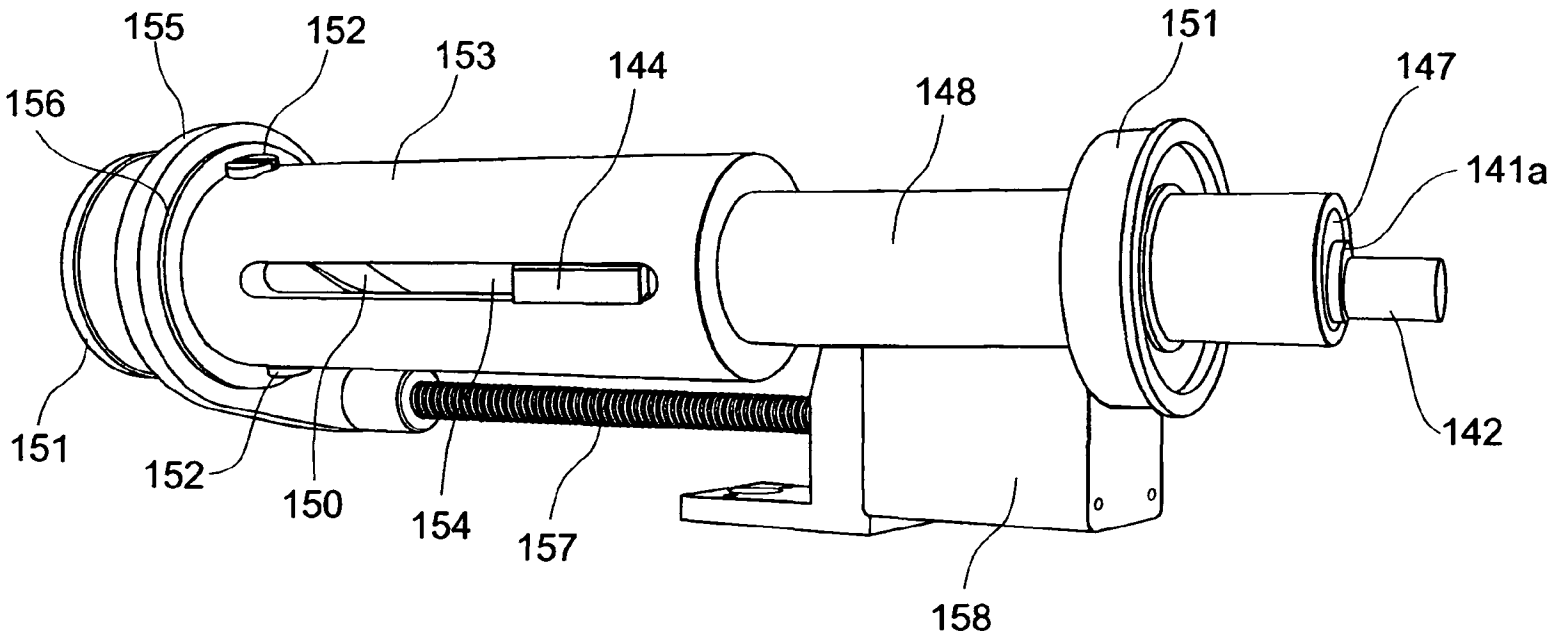
FIG. 10 shows a perspective view of the displacement assembly shown in FIG. 6.

FIG. 10 shows a perspective view of displacement assembly 140. In relation to FIGS. 8 to 9, additional components of displacement assembly 140 are now shown. Once again the eccentric placement of extension shaft 142 within end face 141*a* is apparent as is the eccentric placement of eccentric shaft 141 within bushings 147 and sleeve 148. Sleeve 148 sits within bearings 151 provided at both ends thereof. Pins 152 are fastened within a casing or shuttle 153 and have their lower extent located within groove 150 of sleeve 148 and adapted to travel within that groove 150. Shuttle 153 encloses a portion of sleeve 148 and can travel along its length between bearings 151.

Shuttle 153 is provided with an elongate cut away portion or slot 154 in which elongate projection 144 of locking mechanism 143 sits and can travel within. Adjacent pins 152 is a displacement member or yolk 155 which encloses an end of shuttle 153 and sits on bearing 156 located between it and shuttle 153. Some form of simple seal or clip will be located between bearing 156 and shuttle 153 to effectively fasten yolk 155 to the surface thereof but allow for relative motion of shuttle 153 within yolk 155. This means that when yolk 155 moves forwards or backwards then shuttle 153 will be moved along with it. Yolk 155 is fixed at its lower extent to a threaded spindle 157 which extends from a stepper motor 158 or like DC motor with positional recognition capability.

It will be appreciated that activating stepper motor 158 to draw yolk 155 towards itself will result in yolk 155 applying a displacement pressure on shuttle 153. This will force the attached pins 152 to move along groove or grooves 150 and, due to the spiralling nature of grooves 150, will result in shuttle 153 being forced to rotate within bearings 156 relative to the underlying sleeve 148. This rotation will be transferred to elongate projection 144, which will also be travelling along the length of slot 154, and due to eccentric shafts 141 being locked in place within locking mechanism 143 a like degree of relative rotation will be imparted to eccentric shafts 141. Since eccentric shafts 141 are able to rotate within bushings 147 and hence sleeve 148, this relative movement results in the position of extension shaft 142 relative to the centre of bushings 147 and sleeve 148 being changed which translates into a change in amplitude of displacement of connecting rod 116 and hence vibration platform 111. This action and the range of amplitude change it brings about are better seen in FIGS. 11 through to 13.

Figure 11B:
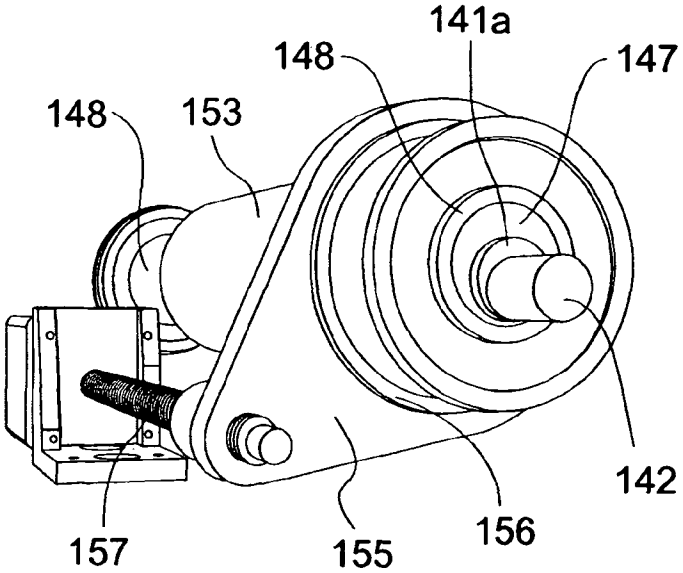
FIG. 11B shows a perspective view of the displacement assembly shown in FIG. 11A.
Figure 11A:
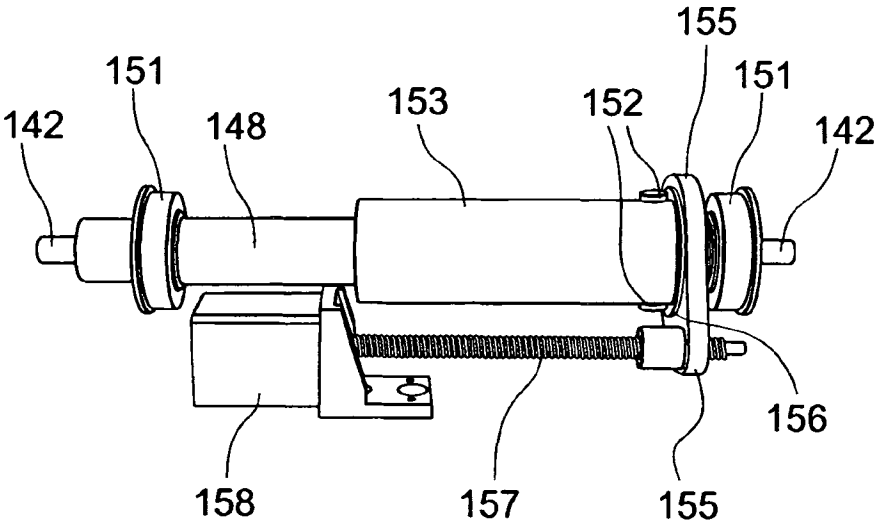
FIG. 11A shows a side view of the displacement assembly of FIG. 10 when at high amplitude setting.

FIG. 11A shows a side view of displacement assembly 140 shown in FIG. 10 when at high amplitude setting while FIG. 11B shows a perspective view of the same assembly. Yolk 155 is located on an end of spindle 157 furthest away from stepper motor 158 which means shuttle 153 is similarly located at one end of sleeve 148 and pins 152 are sitting at the beginning of grooves 150. This also results in elongate projection 144 adopting the position shown in FIG. 10. FIG. 11B clearly shows how the positioning of the components described results in extension shaft 142 adopting a maximum eccentric position in relation to the centre of bushings 147 and sleeve 148.

In reality all of components such as eccentric shafts 141, locking mechanism 143, sleeve 148 and shuttle 153 will be rotating due to motor 121 and driving belt 125. This means that extension shaft 142 will be undergoing eccentric motion resulting in its vertical displacement from a low position, as shown in FIG. 11B wherein it will be closer, relatively, to base 130 to which stepper motor 158 is attached, to a high position wherein it is located closer to vibration platform 111. Since extension shaft 142, as shown in FIG. 11B, is located towards the outer region or circumference of the circle formed by the body of sleeve 148, the distance between these high and low positions is maximal and may be in the region of 15 mm.

Figure 12B:
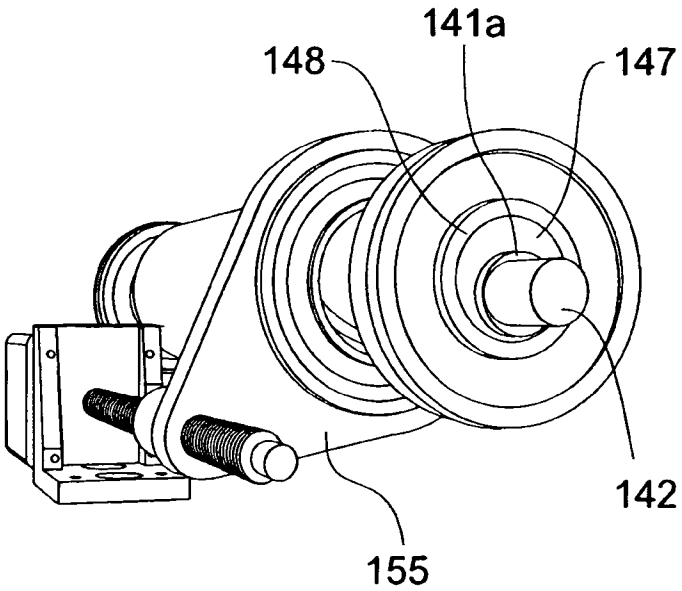
FIG. 12B shows a perspective view of the displacement assembly shown in FIG. 12A.
Figure 12A:
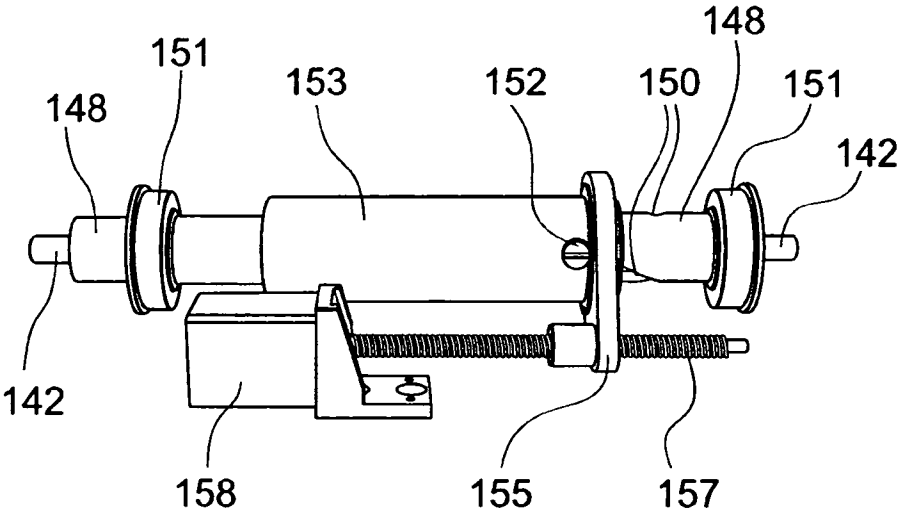
FIG. 12A shows a side view of the displacement assembly of FIG. 10 when at an intermediate amplitude setting.

FIG. 12A shows a side view of the displacement assembly of FIG. 10 when at an intermediate amplitude setting while FIG. 12B shows a perspective view of the same assembly. Relative to the views seen in FIGS. 11A and 11B, stepper motor 158 has been activated for FIGS. 12A and 12B and this has resulted in yolk 155 being drawn along threaded spindle 157 to sit closer to stepper motor 158. Consequently, shuttle 153 has been drawn with yolk 155 to sit over a central region of sleeve 148. During this motion pins 152 would have travelled along spiral grooves 150 and so shuttle 153 to which they are fixed would have been forced to rotate. This is apparent in the change of the position of pins 152 from sitting adjacent the top and bottom of sleeve 148 in FIG. 11A vertically opposite to being located about midway down its width and horizontally opposite. The movement of shuttle 153 will have effected a like displacement of locking mechanism 143 due to elongate projection 144 sitting within slot 154. The rotation of locking mechanism 143 has resulted in extension shaft 142 adopting a position which is closer to the centre of the circles formed by bushings 147 and sleeve 148 than is seen in FIG. 11B, that is, the eccentricity of extension shaft 142 has been reduced. Thus, when eccentric shafts 141 are rotating, the distance between the high and low positions of extension shaft 142 is less than for FIG. 11B. This results in a smaller vertical displacement of connecting rod 116 and thus a smaller amplitude of oscillation of vibration platform 111. In this case the amplitude displacement may be about 8.5 mm.

Figure 13B:
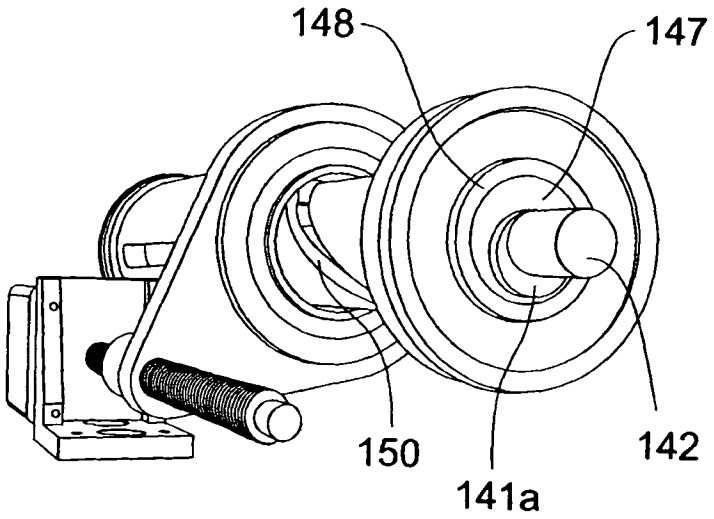
FIG. 13B shows a perspective view of the displacement assembly shown in FIG. 13A.
Figure 13A:
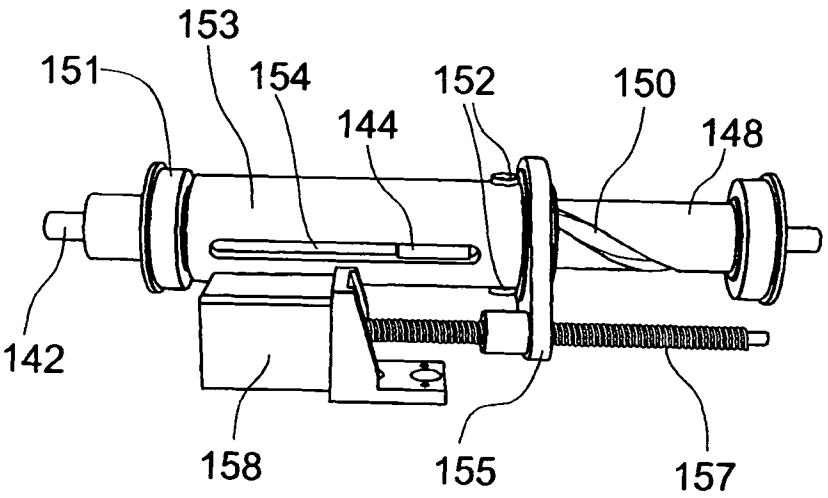
FIG. 13A shows a side view of the displacement assembly of FIG. 10 when at low amplitude setting.

FIG. 13A shows a side view of the displacement assembly of FIG. 10 when at low amplitude setting while FIG. 13B shows a perspective view of the same assembly. Stepper motor 158 has been further activated relative to the situation shown in FIGS. 12A and 12B and so yolk 155 has been drawn further along spindle 157, even closer to stepper motor 158. This has resulted in shuttle 153 reaching the opposite bearing 151 to the one it began adjacent to and covering the associated end of sleeve 148. Each pin 152 has travelled along the extent of grooves 150 and ended up 180° vertically from their starting position. Elongate projection 144 has travelled along the full extent of slot 154, which may be in the region of an 80 mm travel distance. The resultant change in the position of extension shaft 142 can be clearly seen in FIG. 13B where it is apparent that it is sitting quite close to the centre of the circles formed by bushings 147 and sleeve 148. This means that its degree of eccentricity has been greatly decreased from that seen in FIGS. 11A and 11B and so the distance between its high and low positions will be less. As described previously, this results in a lower amplitude setting for vibration platform 11 and may be, for example, in the order of 2 mm.

Shuttle 153 can thus be moved forwards and backwards by controlling stepper motor 158. This can be simply achieved by provision of a selector panel electrically connected thereto which is easily accessed by the user. The movement of shuttle 153 along sleeve 148 results in rotation of eccentric shafts 141 and associated extension shafts 142 to thereby vary, in a continuous manner, the eccentricity, and hence amplitude displacement, of extension shafts 142. Due to the connection of connecting rod 116, atone end, to extension shafts 142 and, at its other extent, to side panel 113 this movement of extension shafts 142 is translated into see saw like movement or oscillation of vibration platform 111 around cross bar 114 acting as a fulcrum.

Although differing in detail it will be appreciated that the two embodiments represented by vibration apparatus 10 and 100 share an underlying mechanism in using a displacement mechanism, such as a stepper motor and associated yolk 155 or roller carrier 60 to effect a change in the positioning of one or more components to alter displacement of a link connecting them to the vibration platform.

Thus it will be appreciated that the present invention provides control over the amplitude of vibration of a vibration platform as defined by the range of motion of a point source on the vibration platform. If the user of a pivotal vibration training machine comprising a vibration apparatus as described herein wishes to change the amplitude of vibration of the platform upon which they are exercising then it is a simple matter of pushing a button to activate a stepper motor which will bring about a series of changes, as described above, to either increase or decrease the vibration amplitude. This provides control of the amplitude continuously between a minimum and maximum value rather than a mere choice between two different values as is typically provided for by lineal vibration machines.

The present invention provides substantial benefits to the user in terms of improved control over the G force output from the pivotal machine and enables pivotal vibration training machines to enjoy wider application than was previously possible.

It has been shown that the optimal vibrational frequency to activate a muscle's stretch reflex and cause contraction is around 30 Hz. Although not wishing to be bound by any particular theory it is believed that because the stretch reflex of a muscle takes approximately 35-50 millisec to complete the muscle can only absorb around 20-30 vibrations per second. Frequencies higher than about 30 Hz will thus be capable of being absorbed by bone tissue and can then provide the observed benefits of increasing bone density which is particularly important for the elderly. The present invention is capable of operating at frequencies of from about 5 to about 35 Hz.

Previously, pivotal vibration machines were not particularly well suited to this application because the combination of their inherently large displacement amplitude with a frequency above 30 Hz would result in an excessively large G force being experienced by the user and could even result in injury.

The present invention provides a solution to this problem since the amplitude of vibration can be reduced when higher frequencies are needed to thereby maintain the G force at a relatively low magnitude. The present invention will be used in conjunction with software which calculates the relationship between the vibrational amplitude and frequency to ensure that the G force is always within safe limits. For example, if a user increases the vibrational amplitude to a maximum value then, at a point before excessive G forces would be reached, the software will automatically lower the frequency of the vibrations to provide G force control.

The present invention allows user's to continue to enjoy the acknowledged benefits of pivotal vibration training but has removed the disadvantages relating to lack of control over vibration amplitude and, so, G force output.

The various features and embodiments of the present invention, referred to in individual sections above apply, as appropriate, to other sections, mutatis mutandis. Consequently features specified in one section may be combined with features specified in other sections as appropriate.

Throughout the specification the aim has been to describe the preferred embodiments of the invention without limiting the invention to any one embodiment or specific collection of features. It will therefore be appreciated by those of skill in the art that, in light of the instant disclosure, various modifications and changes can be made in the particular embodiments exemplified without departing from the scope of the present invention.

The invention claimed is:

1. A pivotal vibration apparatus comprising:

(a) a vibration platform;

(b) a displacement assembly comprising an eccentric shaft rotatable to provide a displacement amplitude;

(c) a link connecting the displacement assembly to the vibration platform to transfer the displacement thereto;

(d) an adjustment mechanism to adjust the amplitude of the displacement transmitted to the vibration platform, wherein the eccentric shaft is at least partially enclosed by and rotatable within a sleeve and is located eccentrically therein, and wherein the adjustment mechanism comprises a shuttle partially enclosing and adapted to travel along the sleeve.

2. The vibration apparatus of claim 1 wherein the eccentric shaft has an extension shaft extending from at least one end face thereof.

3. The vibration apparatus of claim 2, wherein the link connects the vibration platform to the extension shaft.

4. The vibration apparatus of claim 3, wherein the link is a connecting rod.

5. The vibration apparatus of claim 2, wherein the extension shaft extends from an eccentric position on the end face of the eccentric shaft.

6. The vibration apparatus of claim 1, wherein the eccentric shaft passes through one or more bushings affixed to the sleeve.

7. The vibration apparatus of claim 1, wherein the sleeve is provided with a window and at least one spiral groove.

8. The vibration apparatus of claim 1 wherein the shuttle is connected to a yolk adapted to move the shuttle along the sleeve.

9. The vibration apparatus of claim 8, wherein the yolk is drawn along a spindle by a position sensitive motor.

10. The vibration apparatus of claim 1, wherein the shuttle is provided with a slot to accommodate the elongate projection of the locking mechanism.

11. The vibration apparatus of claim 10 wherein the shuttle is further provided with at least one pin attached to the shuttle and having an end thereof located within at least one spiral groove of the sleeve.

12. The vibration apparatus of claim 11, wherein movement of the shuttle causes the at least one pin to travel along the at least one spiral groove to thereby cause the shuttle to rotate relative to the sleeve and the elongate projection to travel along the slot.

13. The vibration apparatus of claim 12, wherein rotation of the shuttle causes the locking mechanism and attached eccentric shaft to rotate relative to the sleeve to thereby vary the degree of eccentricity between the extension shaft and a centre point of the sleeve.

14. The vibration apparatus of claim 1, wherein the eccentric shaft is held within a locking mechanism such that rotation of the locking mechanism causes rotation of the eccentric shaft.

15. The vibration apparatus of claim 14, wherein the locking mechanism has an elongate projection extending through the window of the sleeve.

* * * * *